US007278935B2

(12) United States Patent
Wilson

(10) Patent No.: US 7,278,935 B2
(45) Date of Patent: Oct. 9, 2007

(54) SPORTS GOAL

(75) Inventor: John Robert Wilson, Dinnington (GB)

(73) Assignee: Inter Trading Sports Associates Ltd. (GB)

( * ) Notice: Subject to any disclaimer, the term of this patent is extended or adjusted under 35 U.S.C. 154(b) by 0 days.

(21) Appl. No.: 11/355,276

(22) Filed: Feb. 15, 2006

(65) Prior Publication Data

US 2006/0193678 A1 Aug. 31, 2006

(30) Foreign Application Priority Data

Feb. 17, 2005 (GB) ..... 0503248.7

(51) Int. Cl.
*A63B 63/00* (2006.01)

(52) U.S. Cl. ..... 473/478; 473/476; 273/400; 273/127 R

(58) Field of Classification Search ..... 473/476–483, 473/470–473, 197, 454–456; 273/398–402
See application file for complete search history.

(56) References Cited

U.S. PATENT DOCUMENTS

| | | | | |
|---|---|---|---|---|
| 5,080,375 | A | 1/1992 | Moosavi | |
| 5,316,314 | A | 5/1994 | Wilson | |
| 5,413,356 | A * | 5/1995 | Bigelow | 273/400 |
| 5,524,882 | A * | 6/1996 | Wagner | 473/477 |
| 5,539,957 | A * | 7/1996 | Schmidt | 16/331 |
| 5,580,064 | A | 12/1996 | Childers, Jr. | |
| 5,599,024 | A | 2/1997 | Acuff et al. | |
| 5,839,980 | A * | 11/1998 | Kendy | 473/478 |
| 6,027,418 | A * | 2/2000 | van Nimwegen et al. | 473/481 |
| 6,371,873 | B1 * | 4/2002 | Wang | 473/478 |
| 6,375,585 | B1 * | 4/2002 | Driscoll | 473/477 |
| 6,394,917 | B1 * | 5/2002 | Chiappini et al. | 473/415 |
| 6,402,643 | B1 * | 6/2002 | Gill | 473/478 |
| 6,526,789 | B1 * | 3/2003 | Edgerly et al. | 70/232 |
| 6,752,729 | B1 * | 6/2004 | Huang | 473/476 |
| 6,846,253 | B1 * | 1/2005 | Szwalek | 473/446 |
| 2004/0025552 | A1 * | 2/2004 | Yu | 70/358 |
| 2005/0062231 | A1 * | 3/2005 | Oister et al. | 273/407 |
| 2006/0276273 | A1 * | 12/2006 | Perry et al. | 473/481 |

FOREIGN PATENT DOCUMENTS

| | | |
|---|---|---|
| EP | 0 176 317 | 4/1986 |
| GB | 2 347 477 | 9/2000 |
| IE | 71159 | 1/1997 |
| WO | WO 95/24948 | 9/1995 |

* cited by examiner

*Primary Examiner*—Mark S Graham
(74) *Attorney, Agent, or Firm*—Trexler, Bushnell, Giangiorgi, Blackstone & Marr, Ltd.

(57) ABSTRACT

The invention relates to sports goals for games such as football, rugby, hockey etc, where the goals are formed by uprights and crossbars. Because of security issues, there are many instances where goals must be removed for storage when not in use, but secured in place to guard against their improper removal by unauthorized persons, with a substantial guarantee that post and the crossbar do not become disconnected when in use. The objective is met by a sports goal comprising two uprights and a crossbar, and a respective connecting member to attach each upright to the crossbar, each connecting member being secured to a respective end of the crossbar and detachably attached to a respective upright by a spigot on the connecting member or upright slidably engaging a socket on the upright or the connecting member, with a releasable barrel lock to secure the spigot within the socket.

14 Claims, 7 Drawing Sheets

SPORTS GOAL

This application claims the benefit of British application Ser. No. 0503248.7, filed Feb. 17, 2005.

BACKGROUND OF THE INVENTION

This invention relates to sports goals.

In sports such as football, rugby, hockey etc, goals in the form of upright posts and a cross bar are employed. The considerable majority of matches that have no security, and consequently there is a major advantage to be had if the goals are easily readily erected and dismantled to allow their removal from a pitch and transport to a storage area. Equally, there are occasions where goal posts must be erected early and left for a period of time before a game commences, and when security against removal is important. At the same time, and when the goal is in use, the connection between an upright and a crossbar must be such as to offer a substantial guarantee that the uprights will not disconnect from the crossbar whilst the match is in being.

BRIEF SUMMARY OF THE INVENTION

The object of the invention is to provide sports goals that meet the above requirements.

According to a first aspect of the present invention, a sports goal comprises two uprights and a crossbar, and a respective connecting member to attach each upright to the crossbar, each connecting member being secured to a respective end of the crossbar and detachably attached to a respective upright by a spigot on the connecting member or upright slidably engaging a socket on the upright or the connecting member, with a releasable locking means to secure the spigot within the socket, said removable locking means taking the form of a removable barrel lock.

Whilst a spigot may extend from an upright to engage a socket on the connecting member, it is preferred that the spigot extends from the connecting member to engage a socket in the upright.

In the alternative, and in accordance with a second aspect of the present invention, a sports goal comprises two uprights and a crossbar, and a respective connecting member to attach each upright to the crossbar each connecting member being secured to a respective end of an upright and detachably attached to a respective end of the crossbar by a spigot on the connecting member or crossbar slidably engaging a socket on the crossbar or connecting member.

In the circumstance where it is preferred to avoid a rotational movement as between the upright and the connecting member or the connecting member and the crossbar, the connecting member and the upright or crossbar may be formed with matching internal profiling, to create location shoulders internally of the upright or crossbar and connecting member, and to have a rectangular box-like member inserted into the connecting member in engagement with the shoulders, and there secured such as by welding, the box-like member extending out of the connecting member to form a spigot to engage the upright or crossbar where it is secured by the barrel lock. However, when a rearwardly extending net support or rear stanchion is provided, secured by one end to the upper end of a respective upright, and with the other end extending to the ground at a distance from the foot of the upright, preferably with a stabilising strut connection, the rearward end of the net support or stanchion to the foot of the upright, it is preferred for ease of transport and storage for the upright to have a rotational connection to a connecting member on the respective end of the crossbar. Thus, the upright, connecting member, spigot and crossbar can be of circular section, with two holes for the barrel lock formed in the spigot on the connecting member at 90° to each other. Thus, in use, the barrel lock locks the upright to the connecting member, with the net support or stanchion extending rearwardly. When required to be transported or stored, the barrel lock can be removed, the upright rotated to bring the net support or stanchion into the plane of the crossbar, and the barrel lock reinserted to lock the upright to the connecting member and hold the net support or stanchion in the inoperative position.

Further preferably and to secure in removable manner the upright or crossbar to the connecting member, an appropriate barrel locking mechanism is provided to extend through the upright and engage with the spigot, key operated to allow the withdrawal of a locking peg into the barrel, and the insertion of the barrel through a hole in the upright or crossbar and into the aperture in the spigot, when the key can be turned to urge the peg out of the barrel to engage behind the edge of the aperture in the spigot. As an alternative to simply providing co-operating holes in the upright or crossbar and the spigot, a housing may be provided, attached to the upright or crossbar such as by welding, having a passageway to receive the barrel lock, and a shoulder behind which the peg can locate, the barrel lock having an extension to extend through co-operating holes in the upright or crossbar and the spigot.

Each connecting member is preferably directly attached to a respective end of an upright or crossbar. However, it is possible to employ an L-shaped connecting member, one leg of which serves as the connecting member to the upright, and the other leg of which serves as a connector to the crossbar. The L-shaped connecting member may be formed as a moulding or casting or can be a fabrication, with the two legs welded together at a mitred connecting point.

Given the possibility of there being an expansion and contraction of the crossbar dependent on ambient weather conditions particularly on full size goals, it may be that a connection of the member on an upright to a crossbar can allow for expansion and contraction. Thus, the crossbar and the connecting member or second leg of the connecting member can be identically internally profiled to provide location shoulders, and a rectangular connecting piece can be provided, inserted into the end of the connecting member and the respective end of the crossbar in sliding engagement with the location shoulders, the connecting piece being secured to the leg of the connecting member and the end of the crossbar by threaded bolts in relatively loose threaded engagement with the connecting piece, the different in diameter of the threaded bolts extending through the crossbar, and the threaded holes in the connecting piece being such as to accommodate reasonable degrees of expansion of the crossbar.

Each upright may be inserted into a plain socket suitably secured to the ground. However, it is preferred to embed in the ground a support member with a diametral crossbar part way down its length, and to form the end of a respective upright as a bayonet fitting, with opposite L-shaped slots, such that the upright can be lowered into the socket until the crossbar engages the slots and the upright twisted to lock the upright to the locating member. Once a crossbar is in place, the arrangement provides considerable securing against unauthorised removal of the goal posts. Alternatively, a plain locating member with a crossbar can be embedded in the ground, and engaged by a cooperating support member with bayonet fitting to engage the crossbar, the goal post being fitted over the support member, and there being co-operating holes in the goal post and support member for the passage of a barrel lock to secure the goal post to the support member.

Whilst primarily for use with football and the like goals, the invention can readily be adapted to serve as rugby posts. Here, and instead of providing an L-shaped connecting member, a T-shaped connecting member is employed, one leg of which is to connect to a crossbar, the other two in-line legs to connect to a lower post and upper post sections, in the same manner as has been described above.

BRIEF DESCRIPTION OF THE DRAINGS

Several embodiments of the invention will now be described with reference to the accompanying drawings, in which:

FIG. 1 is a side elevation of one embodiment of connection between an upright and a crossbar of a sports goal;

FIG. 2 corresponds to FIG. 1 but shows the upright disconnected;

FIG. 3 corresponds to FIG. 1 but shows a second embodiment of connection;

FIG. 4 corresponds to FIG. 3 but shows the upright disconnected;

FIG. 5 is a side elevation of a third embodiment of the invention;

FIG. 6 corresponds to FIG. 5 but shows the crossbar disconnected;

FIG. 7 corresponds to FIG. 5 but shows a fourth embodiment of the invention;

FIG. 8 corresponds to FIG. 7 but shows the crossbar disconnected;

DETAILED DESCRIPTION OF EMBODIMENTS OF THE INVENTION

Figure 1:
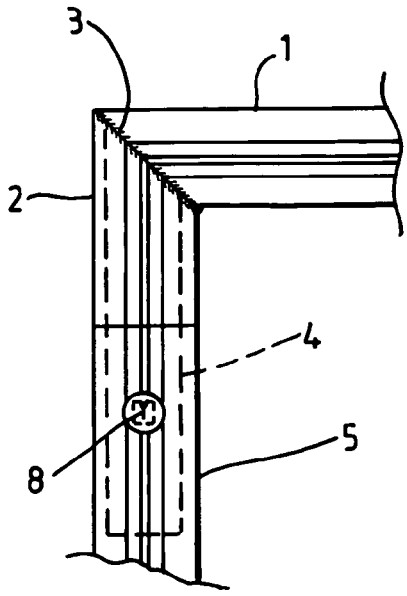
Figure 2:
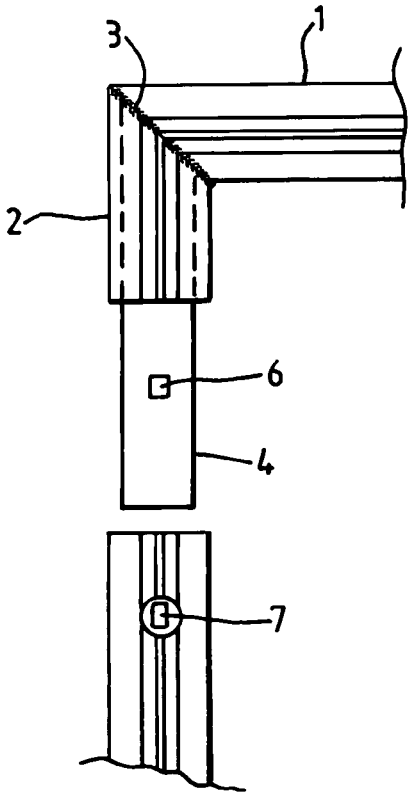

In the embodiment of FIGS. 1 and 2, a crossbar 1 of a goal has secured thereto a connecting member 2, the crossbar and connecting member having a mitred welded joint 3. The connecting member 2 has a spigot 4 secured within it and extending from it and which is a sliding fit within an upright 5 the spigot and the upright having co-operating holes 6, 7 to receive a barrel lock 8, to secure the upright to the connecting member when required (FIG. 1), and which is removed to allow the upright to be detached from the connecting member and crossbar (FIG. 2)

Figure 3:
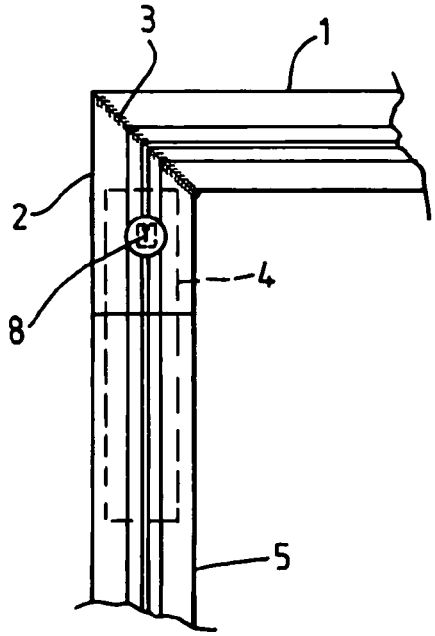
Figure 4:
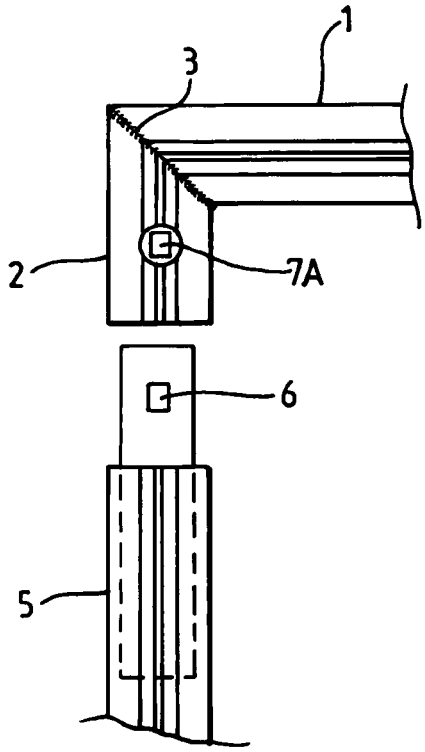

In the essentially similar embodiment of FIGS. 3 and 4, a cross bar 1 is connected to a connecting member 2 by a mitred welded joint 3, and an upright 5 is secured to the connecting member 2 by a barrel lock 8. Here, the spigot 4 is secured within and extends from the upright 5 to a sliding fit in the connecting member 2, and the spigot and connecting member have co-operating holes 6 and 7A to receive the barrel lock 8 when the upright is to be connected to the connecting member and crossbar (FIG. 3) and which is removed to allow the upright to be detached from the connecting member and crossbar (FIG. 4).

Figure 5:
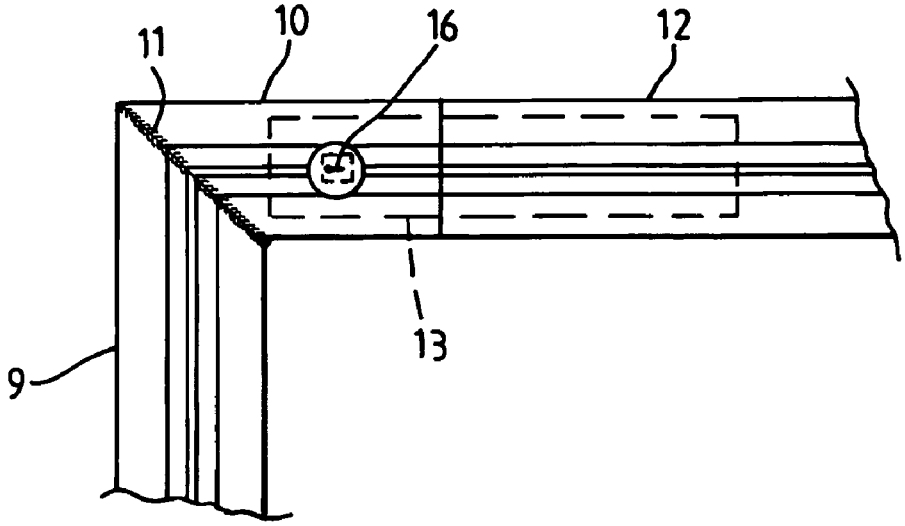
Figure 6:
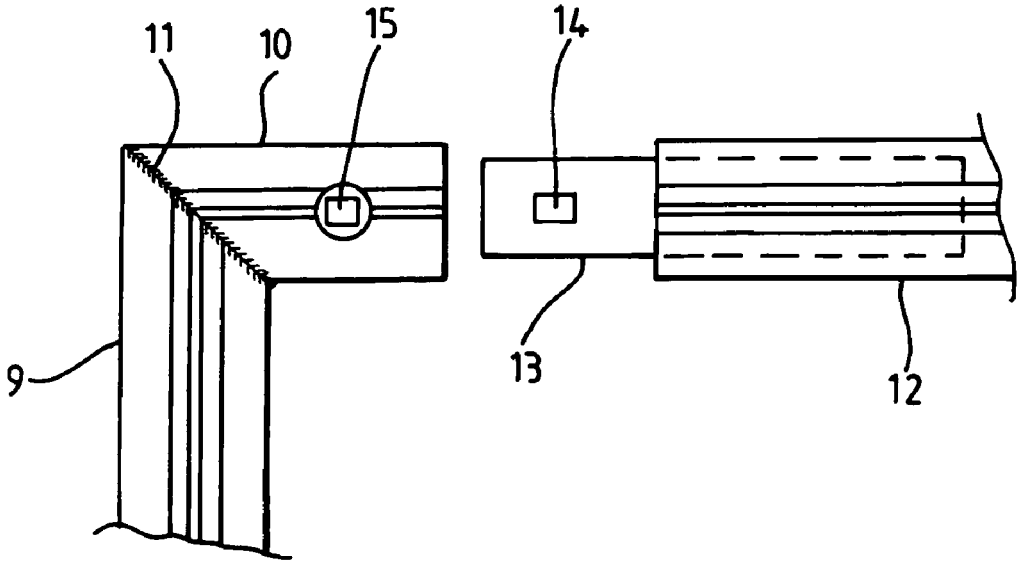

In the construction shown in FIGS. 5 and 6, an upright 9 is secured to a connecting member 10 by way of a mitred welded joint 11, 2 crossbar 12 having a spigot 13 secured within and extending therefrom to be a sliding fit in the connecting member 10. The connecting member 10 and spigot 13 have co-operating holes 14, 15 to receive a barrel lock 16, to secure the crossbar 12 to the connecting member when required (FIG. 5), and which is removed to allow the crossbar to be disconnected from the spigot (FIG. 6).

Figure 7:
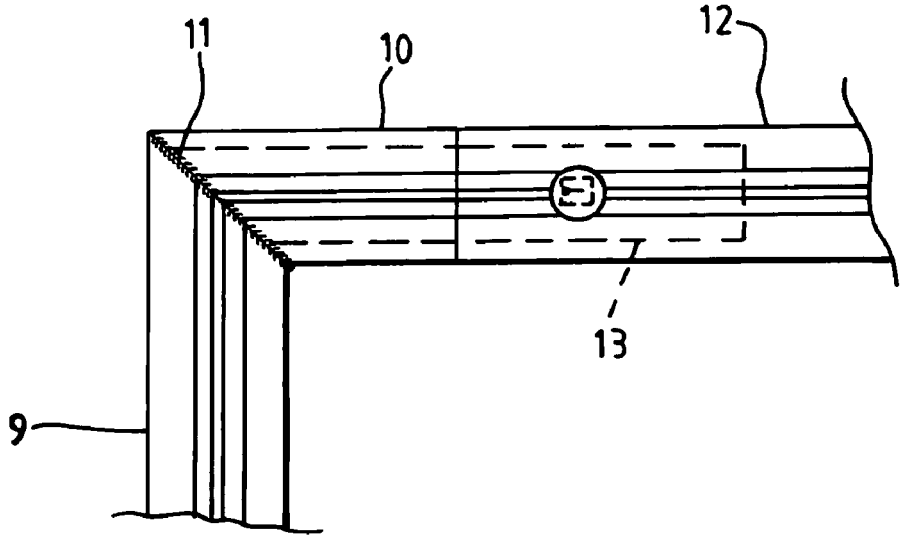
Figure 8:
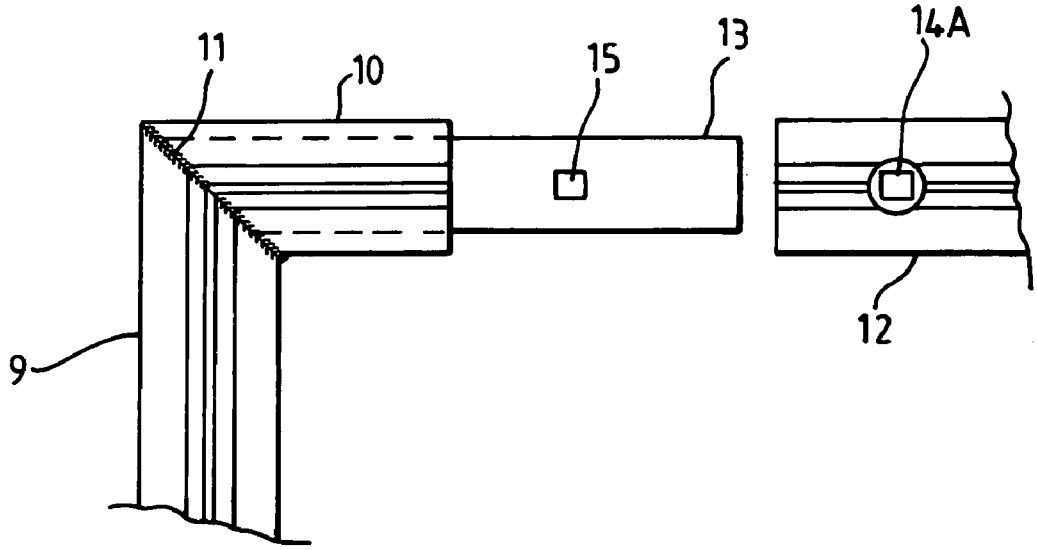

In the essentially similar embodiment of FIGS. 7 and 8, an upright 9 is secured to a connecting member 10 by a mitred welded joint 11, and a spigot 13 is secured within and extends from the connecting member 10, to be a sliding fit in the crossbar 12. The crossbar 12 and spigot 13 have co-operating holes 14A, 15 to receive a barrel lock 16, to secure the crossbar to the connecting member 10 and upright 9 when required (FIG. 7) and which barrel lock is removed to allow the crossbar 12 to be disconnected from the connecting member 10 (FIG. 8).

To assist in the prevention of rotation of the upright in relation to the connecting member (FIGS. 1 to 4) or the crossbar in relation to the connecting member (FIGS. 5 to 8), it is preferred that the spigots 4 and 13 are of non-circular e.g. generally rectangular cross-section to be a sliding fit in a respective connecting member or crossbar provided with internal formations to locate the spigot.

Figure 9:
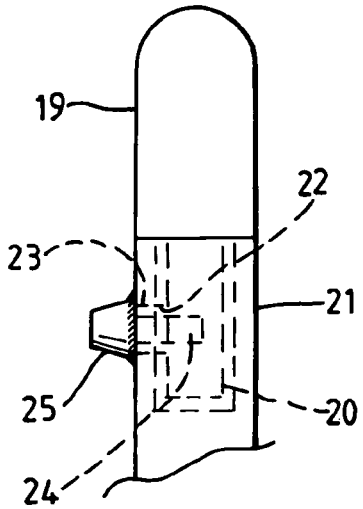
FIG. 9 is a front elevation of a fifth embodiment in the invention.
Figure 10:
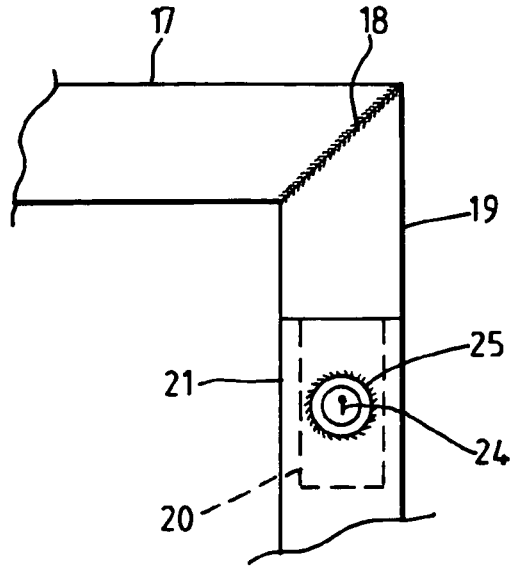
FIG. 10 is a side elevation of FIG. 9.

To provide a potentially less expensive construction, and is illustrated in the embodiments of FIGS. 9 and 10, a crossbar 17 of circular section is secured by way of a mitred welded joint 18 to a circular section connecting member 19, that has a circular sectioned spigot 20 extending into the bore of a circular sectioned upright 21. The spigot 20 and upright 21 having co-operating holes 22, 23 to receive a barrel lock 24 extending through a boss 25 on the upright to secure the upright to the connecting member. With the barrel lock removed, the upright can be detached from the connecting member.

Figure 11:
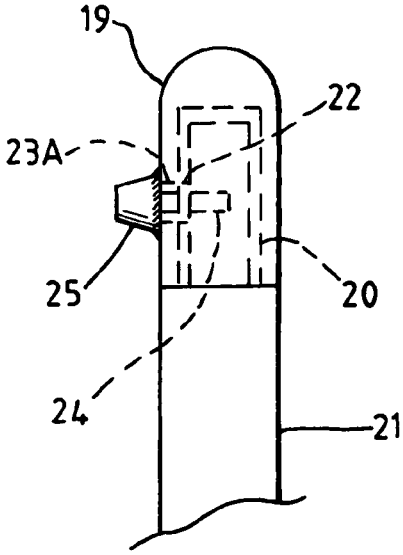
FIG. 11 is a front elevation of a sixth embodiment of the invention.
Figure 12:
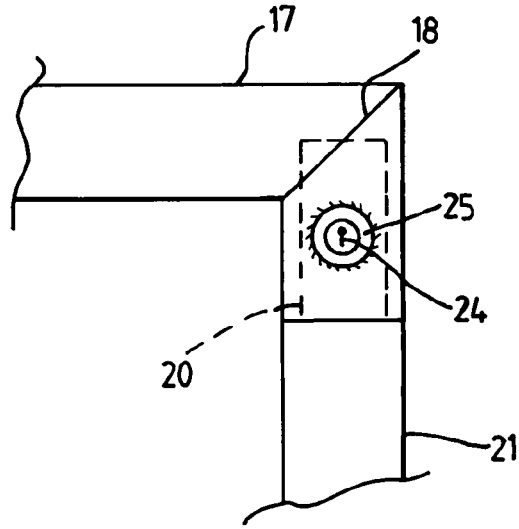
FIG. 12 is a side elevation of FIG. 9.

In the essentially similar embodiment of FIGS. 11 and 12, a crossbar 17 of circular section is secured by way of a mitred welded joint 18 to a connecting member 19 of circular section. The upright 21 of circular section has a spigot 20 secured therein and extending therefrom to engage in the bore of the connecting member, the connecting member and the spigot having co-operating holes 22A and 23 to receive a barrel lock 24, extending through a boss 25 on the connecting member, to secure the upright to the connecting member. Again, with the barrel lock removed, the upright can be disconnected from the connecting member.

Figure 13:
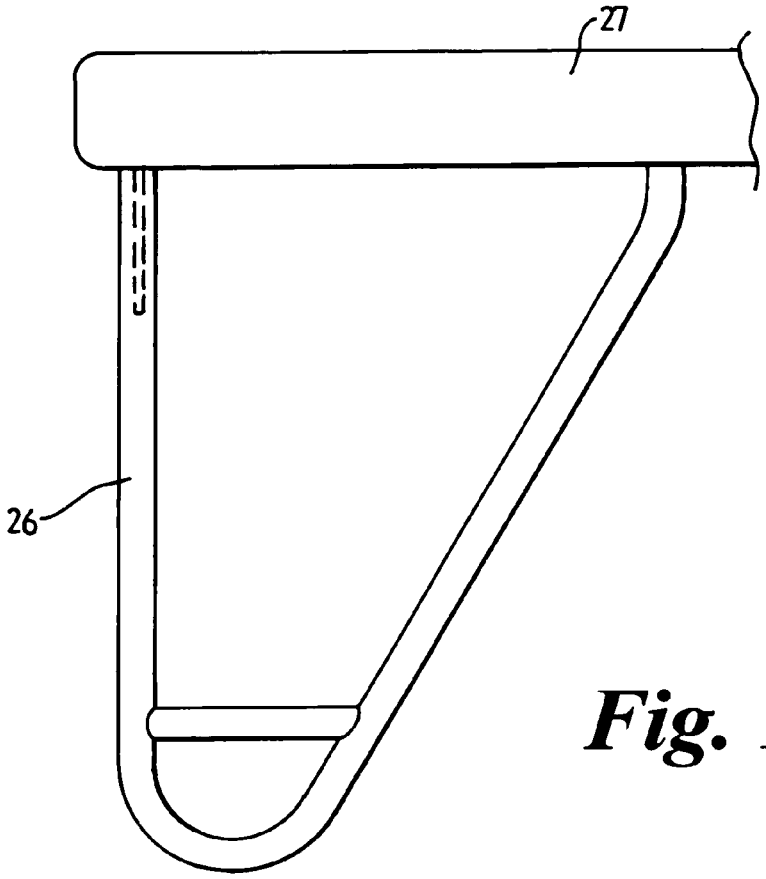
FIG. 13 is plan view of part of a crossbar with one form of net support.

When in use, and with a net attached to the crossbar and upright, a net support can be provided, such as is illustrated in FIG. 13, where a generally U-shaped member 26 is attached to the crossbar 27 towards its outer end, a U-shaped member being similarly provided at the opposite end of the crossbar.

Figure 14:
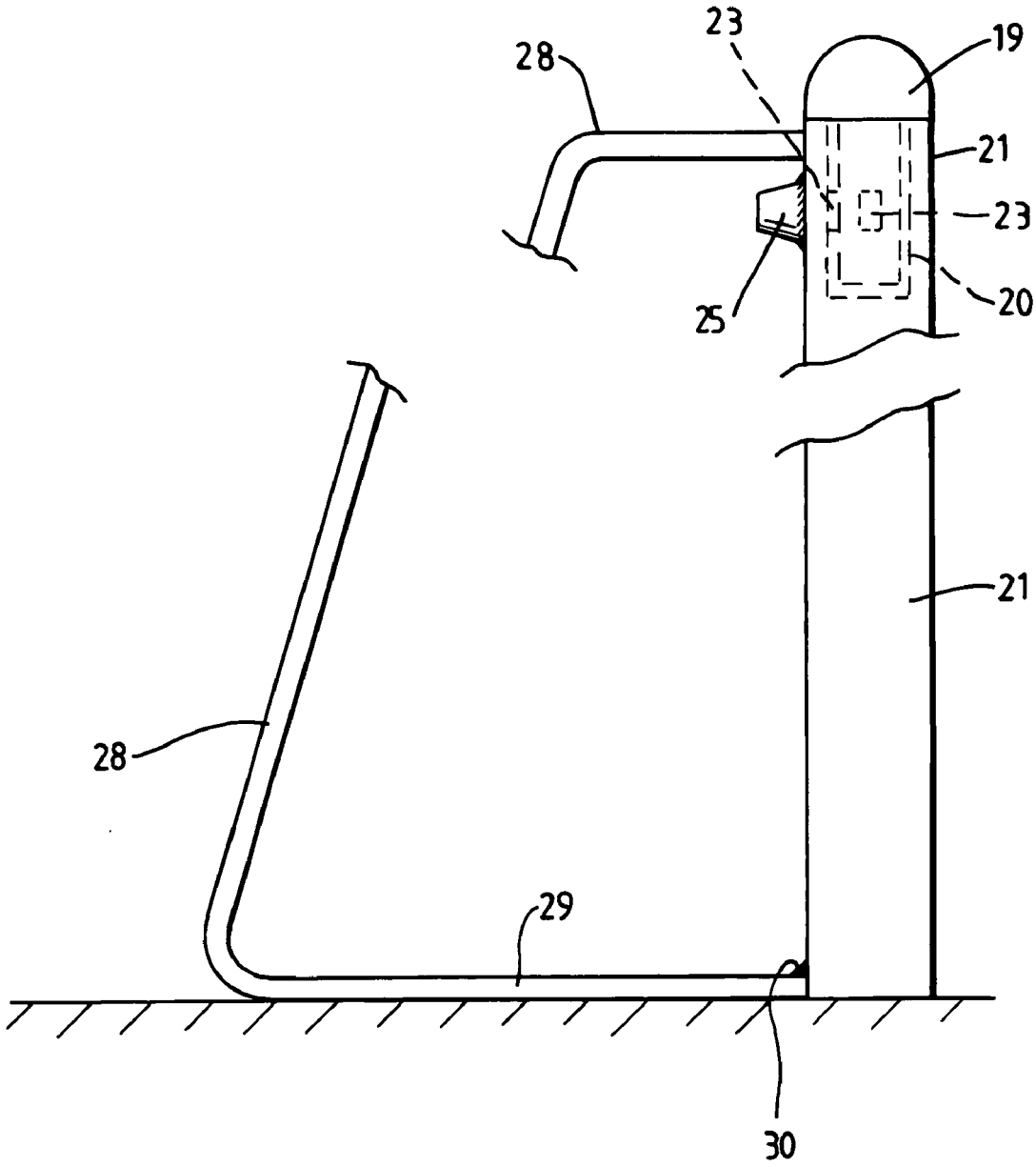
FIG. 14 is a side elevation of the embodiments of FIGS. 9 to 12, and showing the provision of a second form of net support or stanchion.

A further advantage of employing circular section goal posts, is shown in the embodiment illustrated by, FIG. 14. It is frequently so that a net support or rear stanchion is provided to add stability to a goal. Thus, and with, for example, a construction such as is described in relation to FIGS. 9 and 10 a stanchion 28 can be provided attached such as by welding by one end to the upper end of the upright 21 below the connection to the connecting member 19, the stanchion extending rearwardly and downwardly into contact with the floor at a distance behind the goal. A bracing bar 29 is provided connected to the bottom end of the stanchion 28 and extending to the upright where it is connected by a weld 30. The spigot 20 extending between the connecting member 19 and upright 21, has two holes 23 at 90° to each other. In its condition of use, a barrel lock extending through the boss 25 engages one of the holes 23 in the spigot to lock the upright to the spigot and hence connecting member, with the stanchion extending rearwardly of the goal. When the goal is not required, the barrel lock is removed, the upright 21 rotated on the spigot 20, to position the stanchion co-planar with the upright, and the barrel lock reinserted through the boss and into engagement with the second hole 23 in the spigot, to secure the upright and stanchion in a position conducive to transport and storage.

Figure 17:
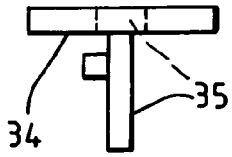
FIG. 17 is a side elevation of FIG. 16.
Figure 16:
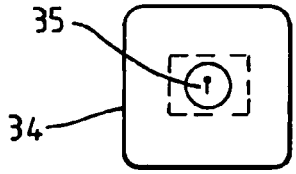
FIG. 16 is a plan view of a cap for the ground anchor of FIG. 15.
Figure 15:
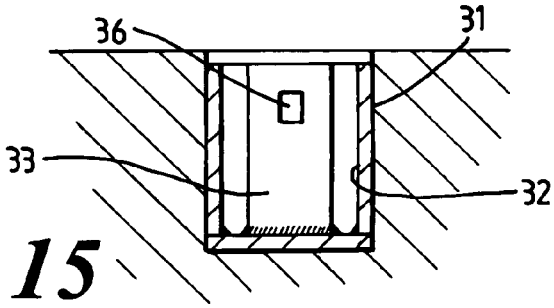
FIG. 15 is a sectional side view of a ground anchor for a post.

To allow the uprights of a goal to be held in a safe, upright disposition, it is possible to provide a ground support. Thus, as is illustrated in FIGS. 15 to 17, a hole 31 can be dug in the ground at a strategic location, and in which is positioned a support box 32 having an upright locating member 33 on to which an upright for a goal can be positioned. When removed from the support box for storage, the support box can be dosed by a lid 34 (FIG. 16) and secured by a barrel lock 35 able to engage a hole 36 in the wall of the upright locating member.

Figure 18:
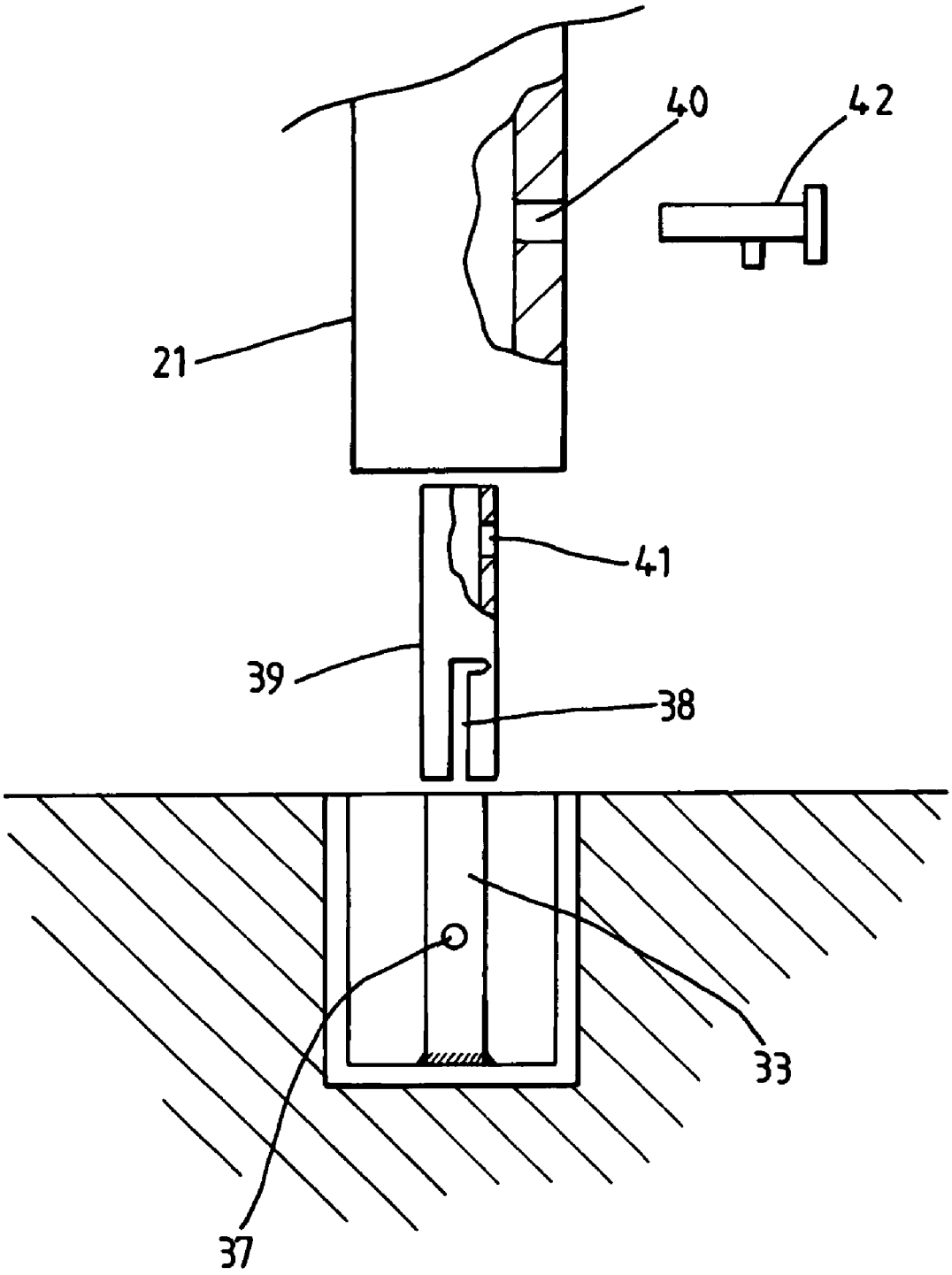
FIG. 18 is part sectional view of a second embodiment of ground anchor.

As is shown in FIG. 18, the locating member 33 can have a crossbar 37 to be engaged by a bayonet slot 38 on a support member 39, and whereby the support member can be removably secured to the locating member. An upright 21 of the goal can be located over the support member 39, and the upright and support member can be provided with co-operating holes 40, 41 to receive a barrel lock 42, to lock the upright to the support member and hence the locating member 33.

The invention claimed is:

1. A sports goal comprising two uprights and a crossbar, and a respective connecting member to attach each upright to the crossbar, each connecting member being secured to a respective end of the crossbar and detachably attached to a respective upright by a spigot on the connecting member or upright slidably engaging a socket on the upright or the connecting member, with a releasable, locking means to secure the spigot within the socket, said removable locking means taking the form of a removable barrel lock.

2. A sports goal as in claim 1, wherein a spigot extends from an upright to engage a socket on the connecting member.

3. A sports goal as in claim 1, wherein a spigot extends from the connecting member to engage a socket in the upright.

4. A sports goal comprising two uprights and a crossbar, and a respective connecting member to attach each upright to the crossbar, each connecting member being secured to a respective end of an upright and detachably attached to a respective end of the crossbar by a spigot on the connecting member or crossbar slidably engaging a socket on the crossbar or connecting member, with a releasable locking means to secure the spigot within the socket, said removable locking means taking the form of a removable barrel lock.

5. A sports goal as in claim 1, wherein to avoid a rotational movement as between the upright and the connecting member or the connecting member and the crossbar, the connecting member and the upright or crossbar are formed with matching internal profiling, to create location shoulders internally of the upright or crossbar and connecting member, and to have a rectangular box-like member inserted into the connecting member in engagement with the shoulders, and there secured, the box-like member extending out of the connecting member to form a spigot to engage the upright or crossbar where it is secured by the barrel lock.

6. A sports goal as in claim 1, wherein when a rearwardly extending net support or rear stanchion is provided, secured by one end to the upper end of a respective upright, and with the other end extending to the ground at a distance from the foot of the upright, preferably with a stabilising strut connection connecting the rearward end of the net support or stanchion to the foot of the upright, the upright has a rotational connection to the connecting member on the respective end of the crossbar.

7. A sports goal as in claim 6, wherein the upright, connecting member, spigot and crossbar are of circular section, with two holes for the barrel lock formed in the spigot on the connecting member at 90 degrees to each other.

8. A sports goal as in claim 1, wherein the removable barrel lock has a withdrawable locking peg to allow the insertion of the barrel through a hole in the upright or crossbar and into an aperture in the spigot, when the key can be turned to urge the peg out of the barrel to engage behind the edge of the aperture in the spigot.

9. A sports goal as in claim 8, wherein a housing is provided attached to the upright or crossbar such as by welding, having a passageway to receive the barrel lock, and a shoulder behind which the peg can locate, the barrel lock having an extension to extend through co-operating holes in the upright or crossbar and the spigot.

10. A sports goal as in claim 1, wherein each connecting member is directly attached to a respective end of an upright or crossbar.

11. A sports goal as in claim 1, wherein an L-shaped connecting member is employed, one leg of which serves as the connecting member to the upright, and the other leg of which serves as a connector to the crossbar.

12. A sports goal as in claim 1, wherein a rear stanchion is provided attached by its upper end to the upper end of an upright, and by a bracing bar extending from its lower end to the foot of the upright.

13. A sports goal as in claim 1, wherein there is embedded in the ground a support member with a diametral crossbar part way down its length, and to form the end of a respective upright as a bayonet fitting, with opposite L-shaped slots, such that the upright can be lowered into the socket until the diametral crossbar engages the slots, and the upright twisted to lock the upright to the support member.

14. A sports goal as in claim 1, wherein a plain locating member with a crossbar is embedded in the ground, and engaged by a co-operating support member with a bayonet fitting to engage the crossbar, the upright being fitted over the support member, and there being cooperating holes in the upright and support member for the passage of a barrel lock to secure the upright to the support member.

* * * * *